United States Patent [19]

Mason

[11] 4,199,181

[45] Apr. 22, 1980

[54] SNOW SHOVEL

[75] Inventor: Winfred A. Mason, St. Louis, Mo.

[73] Assignee: Sidewalk Savage Enterprises, Inc., Clayton, Mo.

[21] Appl. No.: 944,008

[22] Filed: Sep. 20, 1978

[51] Int. Cl.[2] ..... A01B 1/02

[52] U.S. Cl. ..... 294/54; 37/53

[58] Field of Search ..... 294/54, 55, 57, 58, 294/49; 37/53, 44, 46, 47; D8/10

[56] References Cited

U.S. PATENT DOCUMENTS

| | | | |
|---|---|---|---|
| 1,415,979 | 5/1922 | Bedford | 37/53 |
| 1,534,179 | 4/1925 | Klinger | 37/53 |
| 2,919,153 | 12/1959 | Benton | 294/55 |

*Primary Examiner*—James B. Marbert

*Attorney, Agent, or Firm*—Gravely, Lieder & Woodruff

[57] ABSTRACT

A device for removing snow from sidewalks, driveways, and the like. The device is used principally as a plow for pushing the snow off to one side of a snow-covered path. Force which is applied through the handle of the device is distributed over the blade equally so that the blade will not veer from the path to be plowed. The blade is formed from a trapezoidal blank and is diagonally curved to give a sidewise thrust to the snow as it is pushed along the path to be cleaned.

10 Claims, 3 Drawing Figures

SNOW SHOVEL

BACKGROUND OF THE INVENTION

Of the many types of snow removal devices, it is probable that a pusher-type device or plow is the easiest to operate without undue strain on the user. If the snow is deep, or if it retains a high level of water, removal of the snow by means of a conventional shovel-type device is likely to result in fatigue, which combined with the cold, in some cases, causes injury to those removing the snow as is evidenced by the number of deaths and incapacity suffered by those shoveling snow each year.

Conventional snow-pushing devices, or plows, are often inefficient in deep snow due to veering from side to side during use, limiting acceptance of snow pushers by the purchasing public.

The primary object of this invention is to provide a snow shovel having a curved blade which may be used as a snow plow to discharge the snow at one side.

A further object is to provide a snow plow which is effective in relatively deep snow, i.e., up to eight inches or more in depth, or in snow that is heavy due to high water content.

Another object of this invention is to provide a snow removal device which can be pushed through snow in a straight path without veering to either side and which still will discharge the snow to one side of the device due to the curvature of the blade and the positioning of the handle behind the blade.

These and other objects and advantages will become apparent hereinafter.

SUMMARY OF THE INVENTION

This invention involves a snow pusher in which the blade is curved and angled in such a way that slicing through a bank of relatively deep or heavy snow is rendered simple and the snow is discharged to one side of the pusher. In addition, the handle is attached to the blade in such a way that the force applied through the handle by the operator is equally distributed throughout the blade, thus allowing efficient operation in deep snow.

The present device comprises a curved blade which is shaped so as to push snow off to one side, a handle by means of which the user transmits force to the blade, and reinforcing struts which allow the force transmitted to the blade to be equally distributed over the blade.

DESCRIPTION OF THE DRAWINGS

In the accompanying drawings which form part of the specification and wherein like numerals and letters refer to like parts wherever they occur.

DETAILED DESCRIPTION

Figure 1:
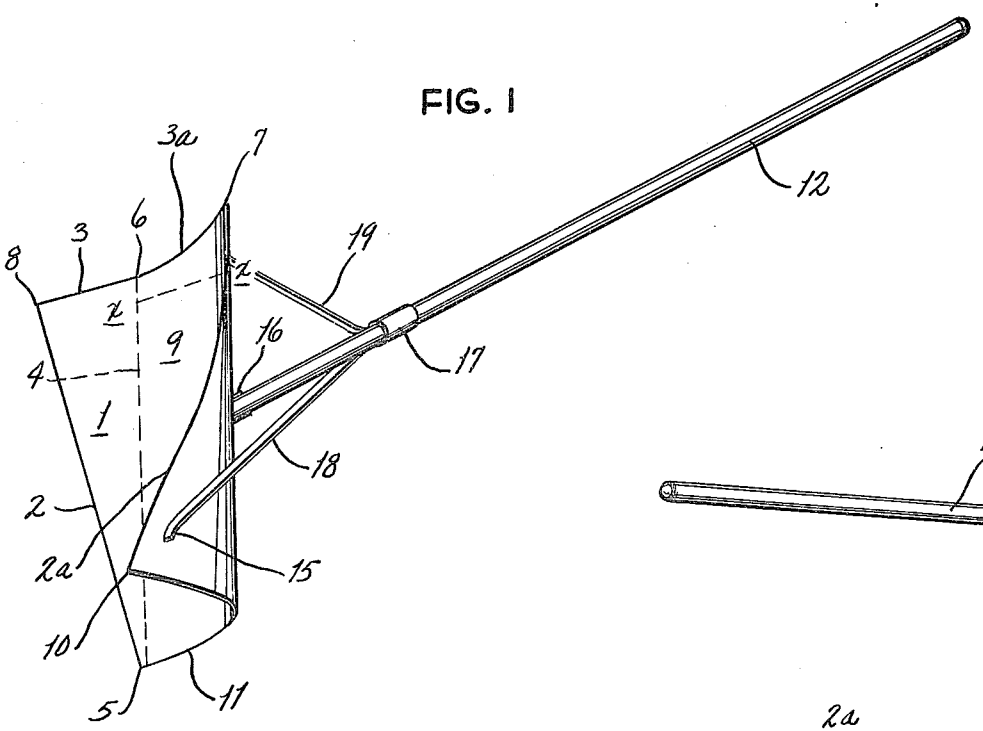
FIG. 1 is a front perspective view of the present device.
Figure 2:
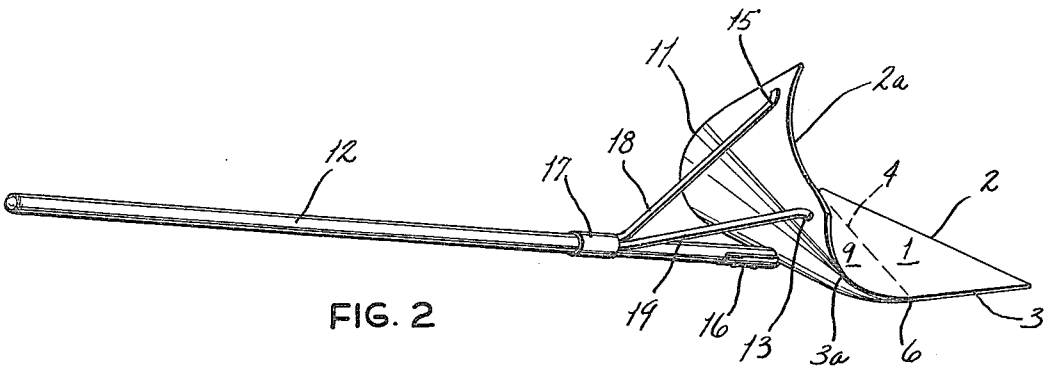
FIG. 2 is a rear perspective view.
Figure 3:
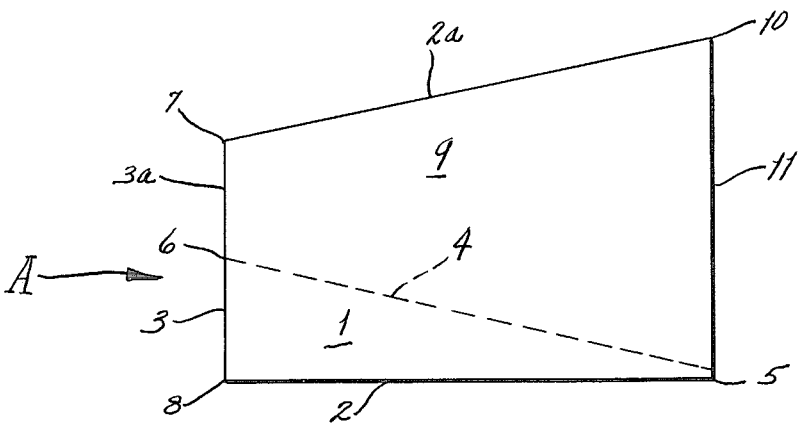
FIG. 3 is a plan view of the blade blank.

FIG. 1 shows a frontal perspective view of the present invention which comprises a blade formed from the blank "A" shown in plan in FIG. 3 blade.

The blank "A" is trapezoidal in shape and comprises a front substantially trianglar portion 1 defined by a front or leading edge 2, a left side edge 3, and a diagonal (represented by the broken line 4). The side edge 3 is substantially perpendicular to the leading edge 2 and the diagonal 4 extends from the right front corner 5 to a point 6 midway between the left rear corner 7 and the left front corner 8. The remainder of the blank "A" is a substantially trapezoidal in shape and is designated by the numeral 9. It comprises the segment 3a of the left side edge from the point 6 to the corner 7, a rear edge 2a, a right side edge 11 which extends between the front corner 5 and the rear corner 10, and the diagonal 4. The right edge 11 is substantially perpendicular to the front edge 2, and parallel to the left edge 3 and 3a. The ratio of the length of the edge 3 or 3a to the edge 2 and further to the edge 11 is about 15:22:18.

After the blank "A" is formed into the curved blade shown in FIG. 1, it has an approximately flat substantially triangular leading portion 1 defined by the front edge 2, the longitudinal or side edge 3 and the diagonal third side 4 (indicated by the broken line in FIG. 1). The portion 9 not embraced within the triangular portion 1 is curved upwardly and forwardly, the curve extending from the rear corner 7 to the rear corner 10.

The curve extends along the longitudinal or side edge 11 to the corner 10. The curve formed by the side edge 11 between the rear corner 10 and the front corner 5 may be described at an arc of approximately 170° to about 190°, preferably 180°.

After the blade is shaped, the distance along the lines x—x from the top 2a to the flat defined by the diagonal 4 is about 8" when the overall dimensions of the edges 3, 3a is about 15", the edge 2 is about 22" and the edge 11 is about 18". Similarly the distance between the points 10 and 5 in the curved blade is about 9.5".

The length of longitudinal edge 11 should exceed the length of longitudinal edge 3, 3a so that the arc-shaped configuration will force the snow out to the side defined by the edge 3, 3a at a sufficiently high rate.

The force utilized to propel the shovel is supplied by the user acting on a handle 12 which is inclined at an angle of approximately 20° from the horizontal as defined by the flat blade portion 1. The force is distributed at three points on the curved blade portion 9. The handle itself 12 is attached to the blade portion 9 by means of a bracket 16. The bracket 16 is welded to the curved blade 9 and the handle 12 is wedged or otherwise fixed in the bracket 16. The bracket 16 is positioned at an angle of about 20° with respect to the horizontal flat blade portion 1.

A first strut 18 extends from the handle 12 and is joined to the blade portion 9 at point 15 by riveting or spot welding. The strut 18 forms an angle of approximately 30° with the handle 12. A second strut 19 extends from the handle 12 and is joined to the blade portion 9 at point 13. The strut 19 forms an angle of approximately 60° with the handle 12.

A sleeve 17 is positioned around the handle 12 and covers the ends of the reinforcing struts 12, 19 at the place where they are joined to the handle 12. The sleeve 17 retains the struts 18, 19 to handle 12.

While additional struts may be employed, the preferred arrangement is two struts and a handle to effect an equal distribution of force.

The handle 12 is positioned such that it joins the blade A near the middle of the lower half of blade portion 9.

The bracket 16 is not only placed at a 20° angle with respect to the horizontal, it also is positioned at about a 15° angle with respect to the edge 2 so that it creates a slicing effect as the blade is being pushed through the snow. The handle 12 then angles toward the open edge 3, 3a of the blade so that it forces the lead point 5 further through the snow. The struts 18, 19 are positioned so that the longer strut 18 is joined to the blade portion 9 in the quadrant of blade portion 9 adjacent to rear corner 10, and the shorter strut 19 is joined to the blade 9 in the quadrant of blade portion 9 adjacent to rear corner 7. The struts 18, 19 may be joined to the sleeve 17 and the blade portion 9 by any conventional means such as bolt-type fasteners and welds.

By means of this three-point force distribution, the user can provide a relatively large force to the upper portion 9 of the blade A. This manner of force distribution allows the operator of the shovel to plow through relatively deep snow, i. e., up to 8 or more inches, and snow that is heavy due to high water content with less effort than would be required with the snow plows that have been known previously.

What is claimed:

1. A snow plow or shovel comprising: a blade formed from a generally trapezoidal blank and defined by a leading edge, long and short side edges that are generally perpendicular to the leading edge, and a rear edge that is oblique with respect to the side edge, the blade having a substantially trianglar portion that is generally flat and a curved rear portion, with leading edge being located in its entirety along the triangular portion and extending cross-wise with respect to the direction that the blade is advanced over a surface to be cleared of snow, the long side edge extending away from a corner of the triangular portion and the short side edge extending along and forming the side of the triangular portion, the triangular flat portion being adapted to lie generally along and immediately over the surface to be cleared of snow as the blade is advanced, the curved rear portion extending generally rearwardly and upwardly with respect to the triangular portion with the long side edge of the blade being located substantially in its entirety along one side of the curved portion and the short side edge of the blade being located in part along the other side of the curved portion, the two side edges being curved upwardly along the sides of the curved section with the long side edge being curved more than the short side edge, the long side edge further being curved such that the corner formed by the intersection of the long side edge and the rear edge is located generally over and spaced upwardly from the triangular flat portion; a handle projecting rearwardly from the curved portion generally midway between the long and short side edges; means for securing the leading end of the handle to the back face of the curved portion; and a strut extended between the handle and the curved portion of the blade, the strut being attached to the curved portion of the blade adjacent to the rear edge.

2. A snow plow or shovel according to claim 1 wherein the handle is straight and is inclined at approximately 20° with respect to the flat triangular portion.

3. A snow plow or shovel according to claim 1 wherein the handle is inclined with respect to the leading edge of the blade so as to effect a slicing action as the blade is pushed through the snow.

4. A snow plow or shovel according to claim 3 where the handle is inclined at about 15° with respect to the leading edge of the blade.

5. A snow plow or shovel according to claim 1 and further comprising another strut extended between the handle and the curved portion of the blade, with the other strut also being attached to the blade adjacent to the rear edge thereof, the one strut being attached to the curved portion of blade adjacent to the corner formed by the intersection of the long side edge and the rear edge and the other strut being attached to the curved portion adjacent to the corner formed by the intersection of the short side edge and the rear edge.

6. A snow plow or shovel according to claim 5 and further comprising a sleeve surrounding the handle rearwardly from the curved portion of the blade and the struts are attached to the handle through the sleeve.

7. A snow plow or shovel according to claim 1 wherein the segment of the short side edge along the triangular portion is about equal in length to the segment of the short side edge along the curved portion.

8. A snow plow or shovel according to claim 1 wherein the means for securing the leading end of the handle comprises a bracket that is attached to the back face of the curved portion for the blade and the leading end of the handle is received in and attached firmly to the bracket.

9. A snow plow or shovel according to claim 1 wherein the triangular flat portion of the blade is separated from the curved portion by a straight line that extends from a point located generally midway between the ends of the short side edge to a point that is located on the long side edge near the corner formed by the intersection of the long side edge and the leading edge.

10. A snow plow or shovel according to claim 1 wherein the long side edge forms an arc ranging between about 170° and 190°.

* * * * *